US011060335B2

(12) United States Patent
Yost

(10) Patent No.: US 11,060,335 B2
(45) Date of Patent: Jul. 13, 2021

(54) ROD SECURING HINGE AND METHOD

(71) Applicant: Overhead Door Corporation, Lewisville, TX (US)

(72) Inventor: Matthew R. Yost, Marion, OH (US)

(73) Assignee: Overhead Door Corporation, Lewisville, TX (US)

( * ) Notice: Subject to any disclaimer, the term of this patent is extended or adjusted under 35 U.S.C. 154(b) by 145 days.

(21) Appl. No.: 15/847,426

(22) Filed: Dec. 19, 2017

(65) Prior Publication Data

US 2019/0186189 A1 Jun. 20, 2019

(51) Int. Cl.

| | |
|---|---|
| ***E05D 15/24*** | (2006.01) |
| ***E05D 3/04*** | (2006.01) |
| ***E05D 11/00*** | (2006.01) |
| *E05D 5/04* | (2006.01) |

(52) U.S. Cl.

CPC ..... *E05D 15/242* (2013.01); *E05D 3/04* (2013.01); *E05D 11/00* (2013.01); *E05D 5/04* (2013.01); *E05Y 2201/688* (2013.01); *E05Y 2600/502* (2013.01); *E05Y 2600/626* (2013.01); *E05Y 2600/632* (2013.01); *E05Y 2800/205* (2013.01); *E05Y 2800/682* (2013.01); *E05Y 2900/106* (2013.01); *E05Y 2900/11* (2013.01); *E05Y 2900/516* (2013.01); *Y10T 16/546* (2015.01)

(58) Field of Classification Search

CPC ..... E05D 15/242; E05D 15/16; E05D 15/165; E05D 3/04; E05D 11/00; E05D 5/04; E05Y 2201/688; E05Y 2600/502; E05Y 2600/626; E05Y 2600/632; E05Y 2800/205; E05Y 2800/682; E05Y 2900/106; E05Y 2900/11; E05Y 2900/516; Y10T 16/546; Y10T 16/533; Y10T 16/5335; Y10T 16/558; Y10T 16/559

USPC ..... 16/365, 250, 251, 387, 388; 160/201

See application file for complete search history.

(56) References Cited

U.S. PATENT DOCUMENTS

| | | | | |
|---|---|---|---|---|
| 1,268,104 | A * | 6/1918 | Flick et al. | E05D 3/12 16/366 |
| 3,376,913 | A | 4/1968 | Clapsaddle | |
| 3,416,589 | A | 12/1968 | Lambein | |
| 4,115,900 | A * | 9/1978 | Mihalcheon | E05D 15/165 16/104 |
| 5,495,640 | A | 3/1996 | Mullet et al. | |
| 6,315,027 | B1 | 11/2001 | Lichy | |
| 6,330,901 | B1 | 12/2001 | Friesen et al. | |
| 6,679,310 | B2 | 1/2004 | De Zen | |
| 6,698,492 | B2 * | 3/2004 | Lewis, Jr. | E05D 15/242 160/201 |

(Continued)

OTHER PUBLICATIONS

International Search Report and Written Opinion dated Mar. 22, 2019 in corresponding International Patent Application No. PCT/US2018/064770, 10 pages.

*Primary Examiner* — William L Miller

(74) *Attorney, Agent, or Firm* — Haynes and Boone, LLP

(57) ABSTRACT

A cap for mounting on a hinge is described. The cap includes: a body defining a first attaching portion for attaching the body to a hinge at a first location; a second attaching portion defined by the body for attaching the body to the hinge at a second location; and a channel defined by the body wherein the body is configured to secure a rod to the hinge by trapping the rod in the channel between the body and the hinge and the channel is located between the first and second attaching portions.

20 Claims, 2 Drawing Sheets

(56) References Cited

U.S. PATENT DOCUMENTS

| | | | | |
|---|---|---|---|---|
| 7,178,197 | B2 * | 2/2007 | Verheye, Sr. | E05D 11/0054 16/250 |
| 7,681,284 | B1 | 3/2010 | Schroeder | |
| 9,546,511 | B2 | 1/2017 | Dittmer | |
| 9,708,841 | B1 * | 7/2017 | Kar | E05D 11/0054 |
| 2005/0273976 | A1 * | 12/2005 | Sarver | E05D 15/242 16/242 |
| 2016/0090768 | A1 | 3/2016 | Mooers | |

* cited by examiner

ROD SECURING HINGE AND METHOD

TECHNICAL FIELD

This patent disclosure relates generally to a hinge and cap assembly and, more particularly, to a hinge and cap assembly for both allowing segments of a door to pivot with respect to each other and securing a wheel to the hinge where the wheel attaches the door to a track.

BACKGROUND

A variety of doors such as garage doors, warehouse doors, and cargo doors on trucks or tractor trailers open and close by moving up or down with wheels moving along tracks. Typically the tracks are located on either side of the door. Wheels connected to the door are located in the tracks and the tracks are curved to cause the door to move from a vertical, closed position to a horizontal, opened position or in some instances to a rolled up opened position.

Such doors are often segmented to allow the door to make a turn or roll up as the door makes the transition to the opened position from a closed position or vice versa. The segments of the door pivot with respect to each other as the door moves along the track from a vertical, closed position to a horizontal, opened position or to a rolled up opened position. Hinges are employed on the doors to allow the segments to be connected to each other and pivot with respect to each other.

The wheels are attached to the door. One place to attach the wheels is at the hinges. Some doors use a cap on the hinge to capture a shaft or rod to which the wheel is mounted. While this works, sometimes the cap does not hold the shaft or rod as securely as desired and may allow the cap to "pull away" from the hinge. Further, when the door is being serviced, to remove the wheel from the door, the cap is removed from the hinge. Removal of the cap may result in the cap being dropped or lost. As a result, it is desired to have a system and method that allows the wheel to be more securely attached to the hinge and reduce the likelihood of the cap from being dropped or lost when servicing the door.

SUMMARY

The foregoing needs are met to a great extent by embodiments in accordance with the present disclosure wherein, in some embodiments, allows the wheel to be more securely attached to the hinge and reduce the likelihood of the cap from being dropped or lost when servicing the door.

In one aspect, the disclosure describes a cap for mounting on a hinge. The cap includes: a body defining a first attaching portion for attaching the body to a hinge at a first location; a second attaching portion defined by the body for attaching the body to the hinge at a second location; and a channel defined by the body wherein the body is configured to secure a rod to the hinge by trapping the rod in the channel between the body and the hinge and the channel is located between the first and second attaching portions.

In another aspect, the disclosure describes a hinge. The hinge includes: a first leaf having a first leaf knuckle defining a hole therethrough; a second leaf having a second leaf knuckle defining a hole therethrough; a cap having a cap knuckle defining a hole therethrough, the cap having a flat portion configured to lay against the first leaf; and an attaching structure defined by the cap and located on the flat portion for attaching the cap to the first leaf.

In yet another aspect, the disclosure describes a method of attaching a wheel to a hinge on a door. The method includes: connecting a cap to the hinge with a pivoting connection at one end of the cap; connecting the cap to the hinge at a second end of the cap; and trapping a wheel mount between the cap and the hinge.

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

There has thus been outlined, rather broadly, certain embodiments of the disclosure in order that the detailed description thereof herein may be better understood, and in order that the present contribution to the art may be better appreciated. There are, of course, additional embodiments of the disclosure that will be described below and which will form the subject matter of the claims appended hereto.

In this respect, before explaining at least one embodiment of the disclosure in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
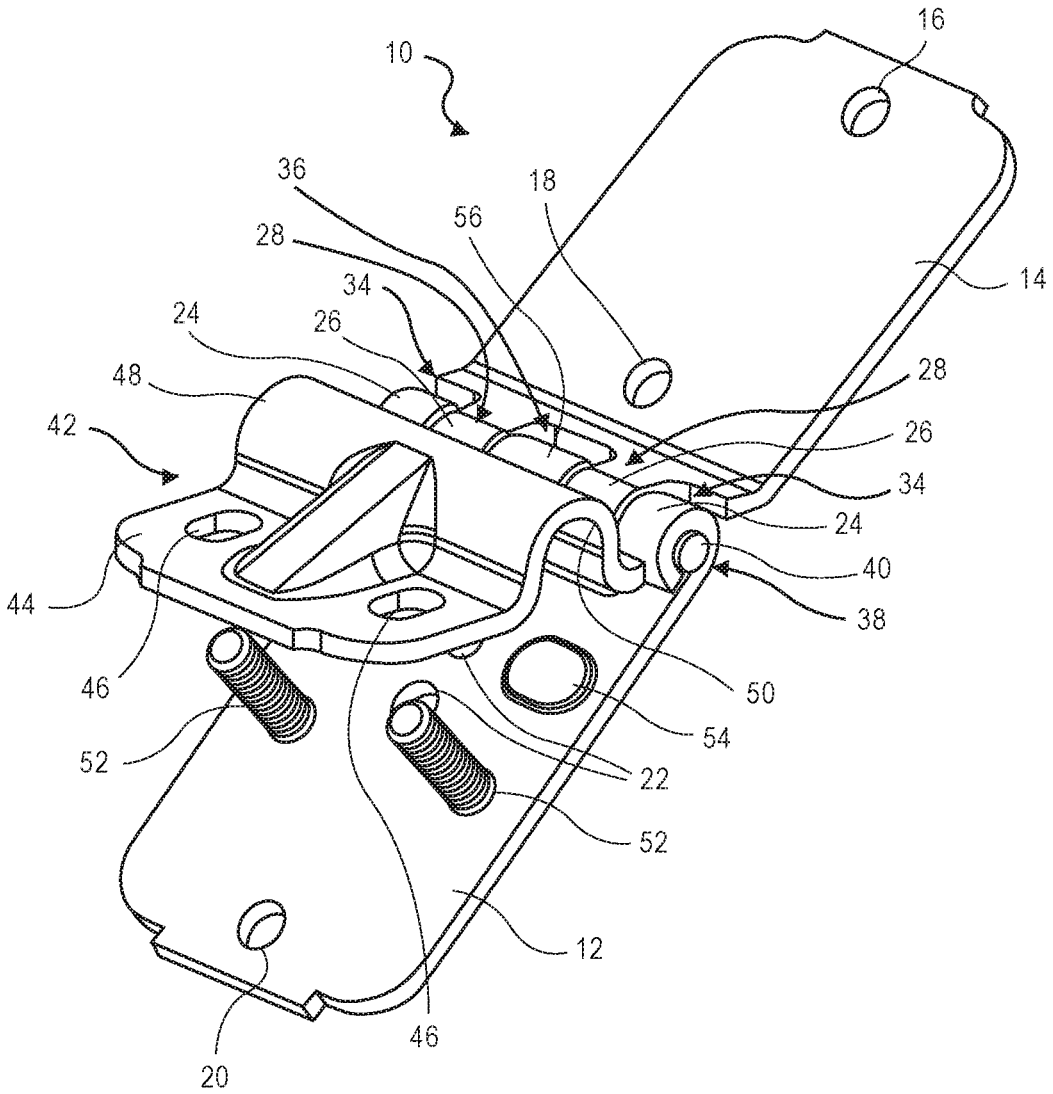
FIG. 1 is a perspective view of a hinge and cap assembly where the cap is only pivotally attached to the hinge in accordance with an embodiment.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

An exemplary embodiment of a hinge 10 in accordance with the disclosure is shown in FIG. 1. The hinge 10 includes a first leaf 12 and a second leaf 14. The first and second leaves 12 and 14 have attaching holes 16, 18, 20, and 22 to enable fasteners such as screws 64 (seen in FIG. 3) to fasten the leaves 12 and 14 (and thereby the hinge 10) to a surface such as a door 62 (see FIG. 3). Typically one leaf 12 is attached to one panel 66 and the other leaf 14 is attached to another panel 68 so that the panels 66 and 68 can pivot via the hinge 10 with respect to each other.

As seen in FIG. 1, the first leaf 12 has at least one first leaf knuckle 24 and the second leaf 14 has at least one second leaf knuckle 26. The first leaf knuckles 24 and the second leaf knuckles 26 may be in a castellated configuration as shown and are off-set from each other to form first leaf knuckle voids 28 and second leaf knuckle voids 34. When the holes in the first leaf knuckles 24 and the second leaf knuckles 26 are aligned, they to form a hinge pin seat 38 to allow a hinge pin 40 to enter the first leaf knuckles 24 and the second leaf knuckles 26. The first leaf knuckle 24 fits in at least one of the second leaf knuckle voids 34 and the second leaf knuckle 26 fits in at least one of the first leaf knuckle voids 28. Both the first leaf knuckles 24 and the second leaf knuckles 26 leave a void 36 which will be discussed further below.

Figure 2:
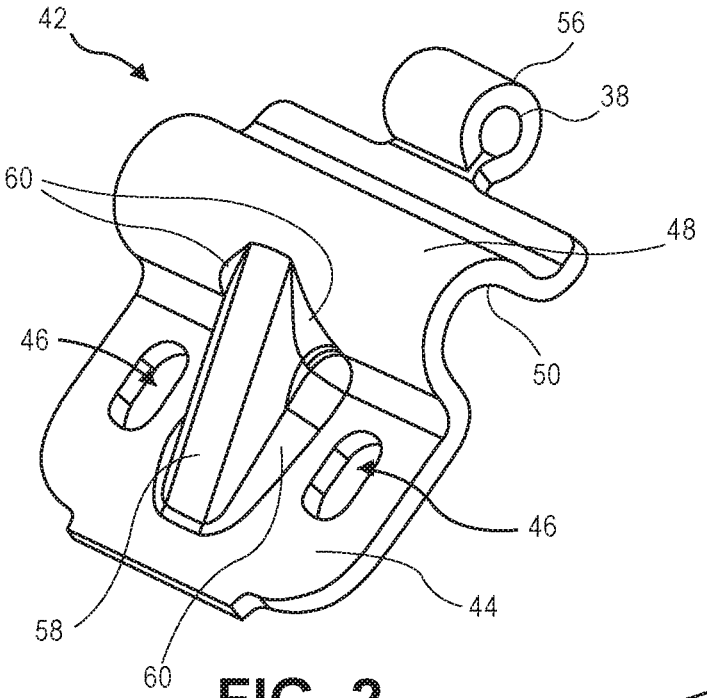
FIG. 2 is a perspective view of a cap not connected to a hinge.
Figure 3:
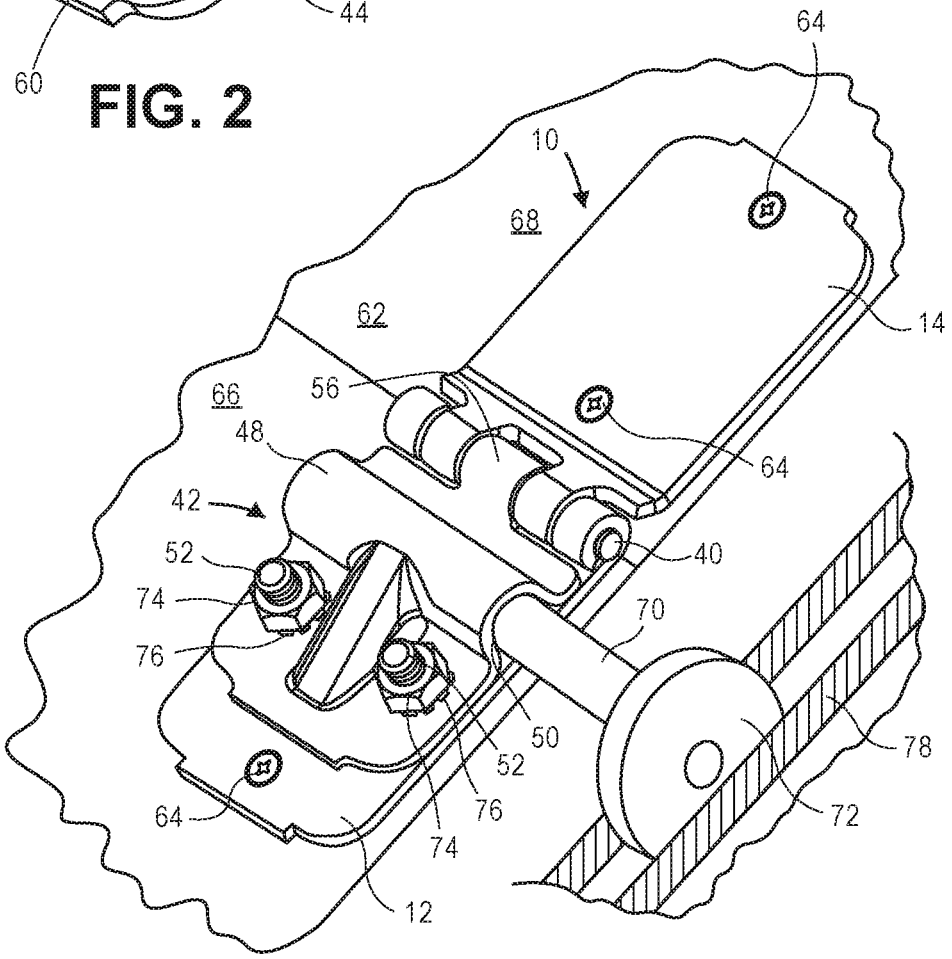
FIG. 3 is a perspective view of a hinge and cap assembly attached to a door and wheel assembly.

The cap 42 is shown in all three FIGS. in various positions. In FIG. 1 the cap 42 is only pivotally attached to the hinge 10. In FIG. 2 the cap is shown by itself. In FIG. 3 the cap is shown attached to the hinge 10 at multiple locations. With reference to FIGS. 1 and 2, the cap 42 includes a relatively flat plate section 44. The plate section 44 defines securing holes 46. The cap 42 has an inverted U-shaped rounded portion 48 which defines a shaft seat 50 in the inverted U-shaped rounded portion 48.

As shown in FIGS. 1 and 3, securing fasteners 52 may extend through or from the first leaf 12. The securing fasteners 52 will extend through the securing holes 46 when the cap 42 is laying against the first leaf 12. The securing holes 46 may be elongated as shown in FIGS. 1 and 2 to allow clearance for the fasteners 52 when cap 42 pivots away from the first leaf 12.

In some embodiments, the first leaf 12 may include a raised portion 54 that is located to extend into the void defined by the rounded portion 48 and help define the shaft seat 50 when the cap 42 is rotated against the first leaf 12.

The cap 42 is pivotally connected to, and rotates with respect to, the first 12 and second 14 leaf via a cap knuckle 56. The cap knuckle 56 defines a hole which is part of the hinge pin seat 38. As shown in FIG. 1, the cap knuckle 56 is offset from the first leaf knuckle 24 and second leaf knuckle 26. The cap knuckle 56 fits into the void 36 left by the first and second leaf knuckles 24 and 26. In the embodiment shown, the cap knuckle 56 fits in a center void 36. However, it will be understood by one of ordinary skill in the art after reviewing this disclosure that the number, location and configuration of the knuckles 24, 26, and 56 and voids 28, 34, and 36 may vary and still be within the scope of this disclosure. The first and second leaves 12 and 14 as well as the cap 42 are all pivotally connected to each other by a hinge pin 40 located in the hinge pin seat 38 defined by the holes in the knuckles 24, 26, and 56.

Returning to FIG. 2, the cap 42 optionally has a reinforcing rib 58 connecting the rounded portion 48 with the plate portion 44. The rib 58 may have filets 60 where the rib 58 connects to the plate portion 44 and the rounded portion 48.

FIG. 3 shows a hinge 10 attached to a door 62. Securing fasteners 64 located in the attaching holes 16-22 (seen in FIG. 1) secure the hinge 10 to the door 62. The first leaf 12 is attached to a first door panel 66 and the second left 14 is attached a second door panel 68. In this manner, the first and second door panels 66 and 68 are able to pivot with respect to each other.

FIG. 3 also shows the cap 42 attached to the first leaf 12 with nuts 74 and washers 76 attached to the securing fasteners 52. The cap 42 is securing a wheel shaft 70 and wheel 72 to the hinge 10. The wheel shaft 70 shown in the FIGS. has a circular cross-sectional shape, however, the wheel shaft 70 may be a rod of any cross-sectional shape. The wheel shaft 70 is captured or trapped between the shaft seat 50 portion of the cap 42 and the first leaf 12. The raised portion 54 may help secure the wheel shaft 70 into the shaft seat 50 by pushing the wheel shaft 70 up into the shaft seat 50 when the nuts 74 are tightened. In some embodiments, the raised portion 54 may help provide an interference fit of the wheel shaft 70 and the shaft seat 50 when the nuts 74 are fully tightened.

The wheel shaft 70 is securely attached to the hinge 10 as the inverted U-shaped portion 48 that defines the shaft seat 50 of the cap 42 is attached to the first leaf 12 of the hinge 10 at either side of the wheel shaft 70. One side of the inverted U-shaped portion is attached to the first leaf 12 and second leaf 14 by the hinge pin 40 in the cap knuckle 56. The other side of the U-shaped portion 48 and shaft seat 50 are secured to the first leaf 12 by the nuts 74 tightened on the threaded securing fasteners or bolts 52.

If it is desired to remove the wheel shaft 70 from the hinge 10, the nuts 74 can be loosened from the securing fasteners 52. Once the nuts 74 are removed, the cap 42 is pivoted on the hinge pin 40 (as seen in FIG. 1) to release the wheel shaft 70. Once the wheel shaft 70 is removed from the hinge 10, the wheel 72 can be removed from the track 78. The embodiments described therein where the cap 42 is connected to the hinge pin 40 offer the advantage of allowing the wheel shaft 70 to be removed while keeping the cap 42 secured. As a result, the likelihood of dropping or losing the cap 42 is reduced.

Various embodiments of the hinge 10 may be made of a variety of materials and in a variety of ways. In the embodiment shown in the FIGS., the first leaf 12, the second leaf 14 and the cap 42 are each a unitary steel part. The first leaf 12, the second leaf 14 and the cap 42 may be stamped and the knuckles 24, 26, and 56 are machine rolled for each part.

While the disclosure has been described in terms of exemplary aspects, those skilled in the art will recognize that the disclosure can be practiced with modifications in the spirit and scope of the appended claims. For example, it will be appreciated that types of fasteners, configurations and orientations of various components may be altered and still fall within the scope of this disclosure. These examples given above are merely illustrative and are not meant to be an exhaustive list of all possible designs, aspects, applications or modifications of the disclosure.

We claim:

1. A hinge, comprising:

a first leaf;

a second leaf connected to the first leaf with a hinge pin; and a cap, the cap comprising:

a body defining a first attaching portion for attaching the body to the hinge at a first location;

a second attaching portion defined by the body for attaching the body to the hinge at a second location; and a channel defined by the body wherein the body is configured to secure a rod to the hinge by trapping the rod in the channel between the body and the hinge and the channel is located between the first and second attaching portions, wherein a raised portion on the first leaf is located to fit in the channel when the cap is secured to the first leaf.

2. The hinge of claim 1, wherein the first attaching portion includes a knuckle defining a hole and the cap attaches to the hinge at the first attaching portion by the hinge pin being located in the hole of the knuckle.

3. The hinge of claim 1, wherein the second attaching portion includes a flat portion defining a fastener hole located and dimensioned to allow a fastener to be located in the fastener hole to secure the cap to the first leaf of the hinge.

4. The hinge of claim 1, wherein the first attaching portion includes a knuckle defining a hole and the cap attaches to the hinge at the first attaching portion by the hinge pin being located in the hole of the knuckle, wherein the second attaching portion includes a flat portion defining a fastener hole located and dimensioned to allow a fastener to be located in the fastener hole to secure the cap to the first leaf of the hinge and the cap is configured to release the rod by pivoting about the hinge pin when the fastener is not securing the cap to the leaf of the hinge at the second attaching portion.

5. A hinge comprising:

a first leaf having a first leaf knuckle defining a hole therethrough;

a second leaf having a second leaf knuckle defining a hole therethrough;

a cap having a cap knuckle defining a hole therethrough, the cap having a flat portion configured to lay against the first leaf, the first leaf, the second leaf, and the cap having a common axis of rotation;

an attaching structure defined by the cap and located on the flat portion for attaching the cap to the first leaf, wherein the attaching structure is releasable from the first leaf when the cap knuckle is disposed about the common axis of rotation; and a channel defined by a discontinuity in the cap, wherein the channel is located between the cap knuckle and the attaching structure and the cap is configured to trap a shaft between the cap and the first leaf in the channel, wherein a raised portion on the first leaf is located to fit in the channel when the cap is secured to the first leaf.

6. The hinge of claim 5, wherein the first leaf knuckle, the second leaf knuckle, and the cap knuckle are off-set from each other to allow the first leaf and the second leaf to lay parallel and in-line with each other and the cap to sit on top of the first and second leaves and in-line with the first and second leaves such that the holes defined by the first leaf knuckle, the second leaf knuckle and the cap knuckle align to allow a hinge pin to be disposed in the holes and connect the first and second leaves and the cap.

7. The hinge of claim 5, further comprising a hinge pin located in the holes of the first leaf knuckle, the second leaf knuckle and the cap knuckle, thereby pivotally connecting the first leaf, the second leaf and the cap together.

8. The hinge of claim 5, wherein the attaching structure includes at least one attaching hole.

9. The hinge of claim 8, wherein the attaching structure includes two attaching holes.

10. The hinge of claim 8, further including a fastener located in the attaching hole thereby connecting the cap at the first leaf.

11. The hinge of claim 8, wherein the attaching hole is elongated.

12. The hinge of claim 5, further comprising a reinforcing rib located on the cap, the reinforcing rib connected to the flat portion and the discontinuity in the cap.

13. The hinge of claim 5, wherein the cap is attached to the first leaf at two places, wherein the discontinuity is between the two places where the cap is attached to the first leaf.

14. The hinge of claim 5, wherein the cap pivots with respect to the first and second leaves when the cap is not secured to the first leaf via the attaching structure and thereby allows the shaft to move out of the channel.

15. The hinge of claim 5, further comprising:

a door to which the hinge is attached;

the shaft located in the channel and trapped between the cap and the first leaf;

a wheel attached to the shaft; and a track defining a pathway for the wheel to travel when the door opens and closes, wherein the wheel is located in the track.

16. A method of attaching a wheel to a hinge comprising:

connecting a cap to the hinge via a pivoting connection with an axis at one end of the cap;

connecting the cap to the hinge at a second end of the cap with a fastener extending through an attaching hole in the cap; and trapping a wheel mount between the cap and the hinge in a channel defined by the cap, wherein a raised portion of the hinge is located to fit in the channel.

17. The method of claim 16, wherein the cap is attached to the hinge via a knuckle on the cap defining a hole therethrough and a hinge pin of the hinge extends through the hole in the knuckle.

18. The method of claim 16, further comprising attaching the hinge to a door.

19. A hinge, comprising:

a first leaf;

a second leaf;

a hinge pin extending through the first leaf and the second leaf; and a cap, the cap comprising:

a body defining a first attaching portion for attaching the body to the first leaf wherein the first attaching portion includes a flat portion defining a fastener hole located and dimensioned to allow a fastener to be located in the fastener hole to releasably secure the cap to the first leaf;

a second attaching portion defined by the body for receiving a portion of the hinge pin; and a channel defined by the body, wherein the body is configured to secure a rod to the first leaf by trapping the rod in the channel between the body and the first leaf, and wherein the channel is located between the first and second attaching portions, wherein a raised portion on the first leaf is located to fit in the channel when the cap is secured to the first leaf.

20. The hinge of claim 19, wherein the second attaching portion includes a knuckle defining a passage through which the hinge pin is disposed.

* * * * *